US006837043B2

(12) United States Patent
Nakatani et al.

(10) Patent No.: US 6,837,043 B2
(45) Date of Patent: Jan. 4, 2005

(54) DEVICE FOR PURIFYING THE EXHAUST GAS OF AN INTERNAL COMBUSTION ENGINE

(75) Inventors: Koichiro Nakatani, Mishima (JP); Shinya Hirota, Susono (JP); Yoshimitsu Henda, Numazu (JP); Kazuhiro Itoh, Mishima (JP); Takamitsu Asanuma, Susono (JP); Koichi Kimura, Nagoya (JP); Shunsuke Toshioka, Numazu (JP); Yasuaki Nakano, Shizuoka-ken (JP); Akira Mikami, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/418,206

(22) Filed: Apr. 18, 2003

(65) Prior Publication Data

US 2003/0196429 A1 Oct. 23, 2003

(30) Foreign Application Priority Data

Apr. 23, 2002 (JP) ..... 2002-121159

(51) Int. Cl.[7] ..... F01N 3/00

(52) U.S. Cl. ..... 60/288; 60/286; 60/292; 60/295; 60/297

(58) Field of Search ..... 60/274, 285, 286, 60/287, 288, 292, 295, 297, 303, 311

(56) References Cited

U.S. PATENT DOCUMENTS

| | | | | | |
|---|---|---|---|---|---|
| 6,055,807 | A | * | 5/2000 | Schatz et al. | 60/274 |
| 6,058,700 | A | * | 5/2000 | Yamashita et al. | 60/285 |
| 6,119,450 | A | * | 9/2000 | Boegner et al. | 60/274 |
| 6,233,927 | B1 | * | 5/2001 | Hirota et al. | 60/297 |
| 6,381,952 | B1 | * | 5/2002 | Asanuma et al. | 60/284 |
| 6,408,620 | B2 | * | 6/2002 | Boegner et al. | 60/295 |
| 2001/0035006 | A1 | * | 11/2001 | Dou et al. | 60/274 |

FOREIGN PATENT DOCUMENTS

| | | |
|---|---|---|
| JP | A 10-238336 | 9/1998 |
| JP | A 11-44211 | 2/1999 |
| JP | A 2000-291422 | 10/2000 |
| JP | A 2001-27114 | 1/2001 |
| JP | A 2001-271633 | 10/2001 |
| JP | A 2002-38932 | 2/2002 |
| JP | A 2002-106330 | 4/2002 |

* cited by examiner

*Primary Examiner*—Tu M. Nguyen
(74) *Attorney, Agent, or Firm*—Oliff & Berridge, PLC

(57) ABSTRACT

A device for purifying the exhaust gas of an internal combustion engine includes a particulate filter carrying an active-oxygen releasing agent that can cause the sulfur poisoning, a $SO_x$ trap unit arranged upstream of the particulate filter, and a bypass section for making the exhaust gas mainly bypass said particulate filter when $SO_x$ is released from the $SO_x$ trap unit. Further, an exhaust choke valve for an exhaust brake is arranged between the $SO_x$ trap unit and the exhaust gas branch portion of the bypass section.

10 Claims, 13 Drawing Sheets

DEVICE FOR PURIFYING THE EXHAUST GAS OF AN INTERNAL COMBUSTION ENGINE

BACKGROUND OF THE INVENTION

1. Field of the Invention

The present invention relates to a device for purifying the exhaust gas of an internal combustion engine.

2. Description of the Related Art

The exhaust gas of a diesel engine contains particulates comprising carbon as the chief component. It is desired that they are not emitted into the atmosphere. For the purpose, it has been suggested that a particulate filter to trap particulates is arranged in the exhaust system.

When the particulate filter traps particulates, resistance to the exhaust gas in the particulate filter increases gradually and thus it is required that the trapped particulates are removed before the resistance becomes very large. For this purpose, Japanese Unexamined Patent Publication No.2001-271633 suggests that the particulate filter carries an active-oxygen releasing agent which holds $NO_x$ to allow, the $NO_x$ to combine with oxygen when excessive oxygen is present in the surroundings, and releases and decomposes the combined $NO_x$ and oxygen into $NO_x$ and active-oxygen when the oxygen concentration in the surroundings drops. The active-oxygen released from the active-oxygen releasing agent can oxidize the trapped particulates favorably on the particulate filter. Thus, the trapped particulates can be automatically removed, Besides, it is also desired that $NO_x$ included in the exhaust gas of the diesel engine is not emitted into the atmosphere. Accordingly, if this particulate filter is used, $NO_x$ in the exhaust gas is absorbed in the active-oxygen releasing agent and thus $NO_x$ can be prevented from being emitted into the atmosphere.

By the way, the active-oxygen releasing agent also holds $SO_x$ in the exhaust gas as it does $NO_x$. The held $SO_x$ is not released even if oxygen concentration in the surrounding merely drops. Accordingly, the amount of $SO_x$ held in the active-oxygen releasing agent on the particulate filter continues to increase. When an amount of held $SO_x$ increases (this is referred to as sulfur poisoning, below), an amount of $NO_x$ that can be held in the particulate filter decreases. The above-mentioned particulate filter is intended to purify $NO_x$ with the oxidization of the trapped particulates. Therefore, if the particulate filter cannot hold $NO_x$ due to the sulfur poisoning, the purification of $NO_x$ becomes insufficient.

To regenerate the sulfur poisoning from the particulate filter, the oxygen concentration in the surrounding is made low and the temperature of the particulate filter is made high. The capacity of the particulate filter is relatively large and thus a large amount of energy is required to heat the particulate filter such that the temperature of the whole particulate filter is made high. Besides, when the temperature of the particulate filter becomes high, the carried active-oxygen releasing agent and noble metal catalyst is deteriorated by the heat.

Accordingly, it is preferable that the sulfur poisoning does not occur in the particulate filter. Japanese Unexamined Patent Publication No.2001-27114 suggests that $SO_x$ trap means is arranged upstream of the catalytic apparatus to trap $SO_x$ before it flows in the catalytic apparatus. Even if an $SO_x$ trap means is used, it cannot continue to trap $SO_x$ limitlessly and, thus, it is required that $SO_x$ must be released therefrom when an amount of $SO_x$ trapped therein reaches a predetermined one. At this time, it is suggested, the exhaust can gas bypass the catalytic apparatus such that the released $SO_x$ does not flow in the catalytic apparatus.

Of course, when $SO_x$ is released from the $SO_x$ trap means, the whole of the $SO_x$ trap means must be heated. The $SO_x$ trap means has a capacity smaller than the particulate filter and thus the energy consumption when the whole $SO_x$ trap means is heated can be made smaller than that when the whole particulate filter is heated. However, a relative large energy consumption is still required when the whole $SO_x$ trap means is heated.

SUMMARY OF THE INVENTION

Therefore, an object of the present invention is to provide a device, for purifying the exhaust gas of an internal combustion engine comprising an exhaust choke valve for an exhaust brake, which can reduce the energy consumption required to regenerate the sulfur poisoning in an $SO_x$ trap apparatus.

According to the present invention, there is provided a device for purifying the exhaust gas of an internal combustion engine comprising a particulate filter carrying an active-oxygen releasing agent that can cause the sulfur poisoning, a $SO_x$ trap unit arranged upstream of the particulate filter, and a bypass means for making the exhaust gas mainly bypass the particulate filter when the $SO_x$ is released from the $SO_x$ trap unit, wherein an exhaust choke valve for an exhaust brake is arranged between the $SO_x$ trap unit and the exhaust gas branch portion of the bypass means.

The present invention will be more fully understood from the description of preferred embodiments of the invention as set forth below, together with the accompanying drawings.

DESCRIPTION OF THE PREFERRED EMBODIMENT

Figure 1:
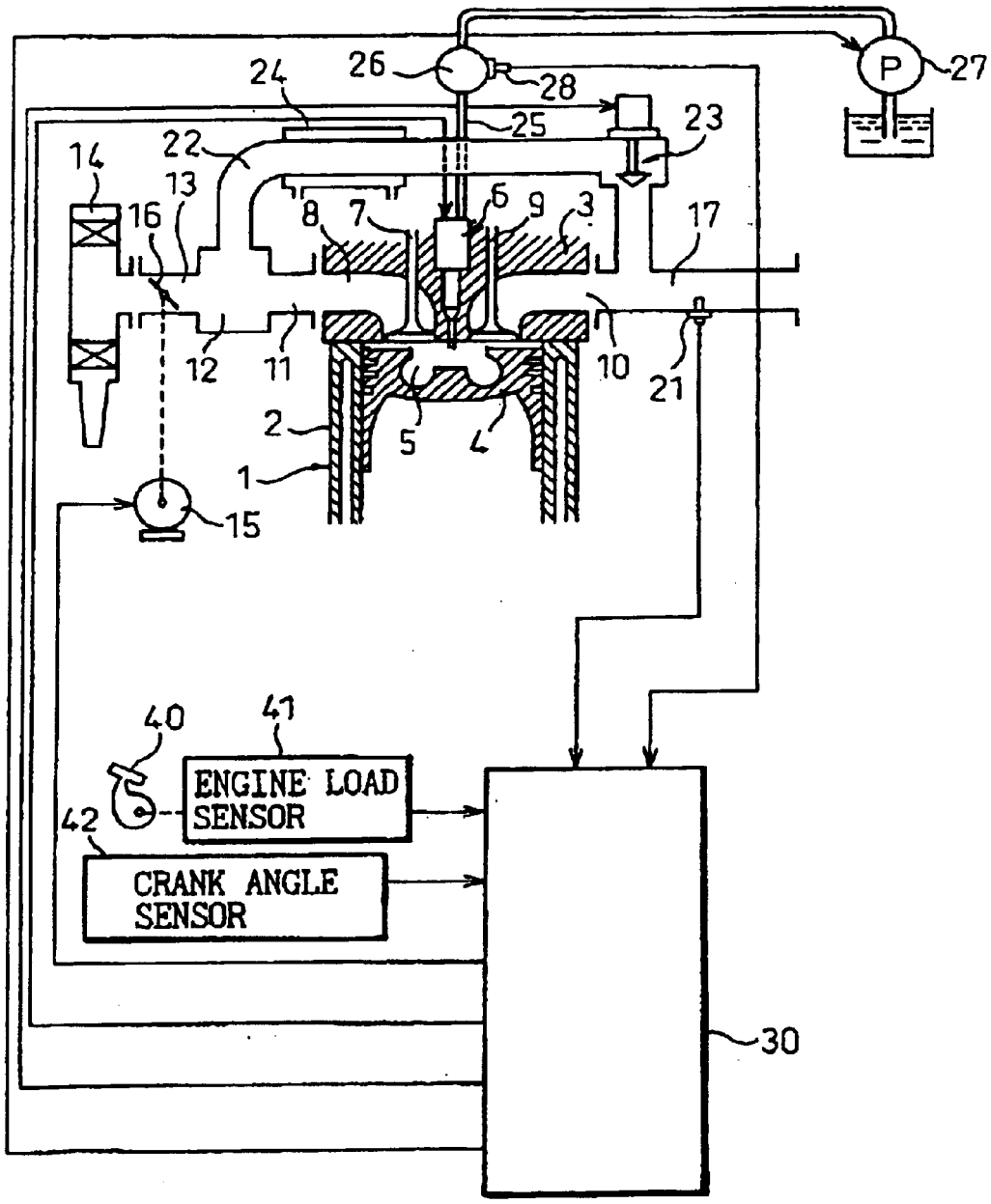
FIG. 1 is a schematic vertical sectional view of a diesel engine with a device for purifying the exhaust gas according to the present invention.

FIG. 1 is a schematic vertical sectional view of a four-stroke diesel engine with a device for purifying the exhaust gas according to the present invention. Reference numeral 1 designates an engine body, reference numeral 2 designates a cylinder-block, reference numeral 3 designates a cylinder-head, reference numeral 4 designates a piston, reference numeral 5*a* designates a cavity formed on the top surface of piston 4, reference numeral 5 designates a combustion chamber formed in the cavity 5*a*, reference numeral 6 designates an electrically controlled fuel injector, reference numeral 7 designates a pair of intake valves, reference numeral 8 designates an intake port, reference numeral 9 designates a pair of exhaust valves, and reference numeral 10 designates an exhaust port. The intake port 8 is connected to a surge tank 12 via a corresponding intake tube 11. The surge tank 12 is connected to an air-cleaner 14 via an intake duct 13. A throttle valve 16 driven by an electric motor 15 is arranged in the intake duct 13. On the other hand, the exhaust port 10 is connected to an exhaust manifold 17.

As shown in FIG. 1, an air-fuel ratio sensor 21 is arranged in the exhaust manifold 17. The exhaust manifold 17 and the surge tank 12 are connected with each other via an EGR passage 22. An electrically controlled EGR control valve 23 is arranged in the EGR passage 22. An EGR cooler 24 is arranged around the EGR passage 22 to cool the EGR gas flowing in the EGR passage 22. In the embodiment of FIG. 1, the engine cooling water is led into the EGR cooler 24 and thus the EGR gas is cooled by the engine cooling water.

On the other hand, each fuel injector 6 is connected to the fuel reservoir, that is, a common rail 26 via a fuel supply tube 25. Fuel is supplied to the common rail 26 from an electrically controlled variable discharge fuel pump 27. Fuel supplied in the common rail 26 is supplied to the fuel injector 6 via each fuel supply tube 25. A fuel pressure sensor 28 for detecting a fuel pressure in the common rail 26 is attached to the common rail 26. The discharge amount of the fuel pump is controlled on the basis of an output signal of the fuel pressure sensor 28 such that the fuel pressure in the common rail 26 becomes the target fuel pressure.

Reference numeral 30 designates an electronic control unit. It is comprised of a digital computer and is provided with a ROM (read only memory), a RAM (random access memory), a CPU (microprocessor), an input port, and an output port connected with each other by a bi-directional bus. The output signals of the air-fuel sensor 21 and the fuel pressure sensor 28 are input to the input port. An engine load sensor 41 is connected to the accelerator pedal 40, which generates an output voltage proportional to the amount of depression (L) of the accelerator pedal 40. The output signal of the engine load sensor 41 is also input to the input port. Further, the output signal of a crank angle sensor 42 for generating an output pulse each time the crankshaft rotates by, for example, 30 degrees is also input to the input port. The fuel injector 6, the electronic motor 15, the EGR control valve 23, the fuel pump 27, and a valve body 71*a* in a changeover portion 71 arranged on the exhaust pipe 18 are connected to the output port to be actuated on the basis of the input signals. The valve body 71*a* will be explained in detail later.

Figure 2:
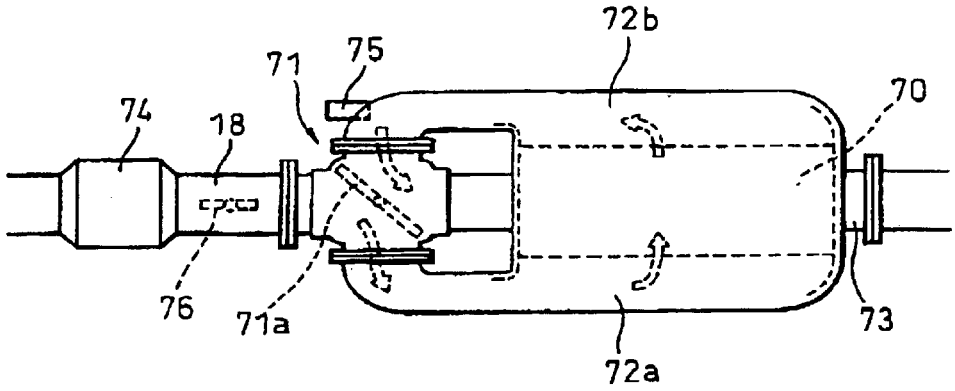
FIG. 2 is a plan view showing near the changeover portion and the particulate filter in the exhaust system.
Figure 3:
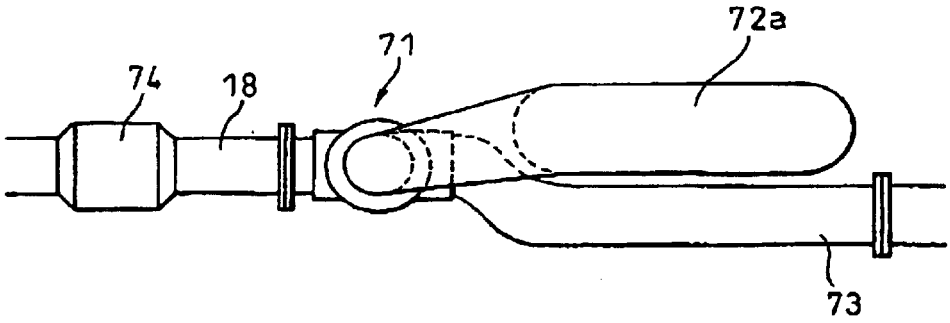
FIG. 3 is a side view of FIG. 2.

FIG. 2 is a plan view illustrating a device for purifying the exhaust gas according to the present embodiment, and FIG. 3 is a side view thereof. The device comprises a changeover portion 71 connected to the downstream of the exhaust manifold 17 via an exhaust pipe 18, a particulate filter 70, a first connecting portion 72*a* for connecting one side of the particulate filter 70 to the changeover portion 71, a second connecting portion 72*b* for connecting the other side of the particulate filter 70 to the changeover portion 71, and an exhaust passage 73 on the downstream of the changeover portion 71. The changeover portion 71 comprises a valve body 71*a* that shuts off the flow of exhaust gas in the changeover portion 71. The valve body 71*a* is driven by a negative pressure actuator, a step motor or the like. At a first shut-off position of the valve body 71*a*, the upstream side in the changeover portion 71 is communicated with the first connecting portion 72*a* and the downstream side therein is communicated with the second connecting portion 72*b*, and thus the exhaust gas flows from one side of the particulate filter 70 to the other side thereof as shown by arrows in FIG. 2.

Figure 4:
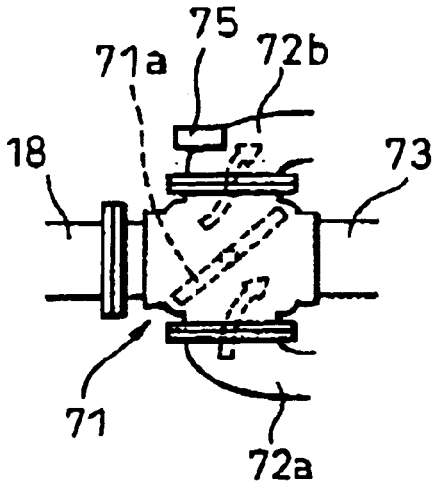
FIG. 4 is a view showing the other shut-off position of the valve body in the changeover portion that is different from that in FIG. 2.
Figure 5:
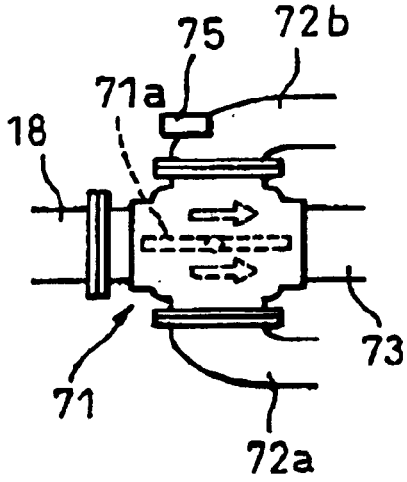
FIG. 5 is a view showing the release position of the valve body in the changeover portion.

FIG. 4 illustrates a second shut-off position of the valve body 71*a*. In this shut-off position, the upstream side in the changeover portion 71 is communicated with the second connecting portion 72*b* and the downstream side in the changeover portion 71 is communicated with the first connecting portion 72*a*, and thus the exhaust gas flows from the other side of the particulate filter 70 to the one side thereof as shown by arrows in FIG. 4. Thus, by changing over the valve body 71*a*, the direction of the exhaust gas flowing into the particulate filter 70 can be reversed, i.e., the exhaust gas upstream side and the exhaust gas downstream side of the particulate filter 70 can be reversed. Further, FIG. 5 shows a release position of the valve body 71*a* between the first shut-off position and the second shut-off position. At the release position, the changeover portion 71 is not shut off. The exhaust gas flows to bypass the particulate filter 70. This means that the exhaust gas passes through a bypass passage. A general bypass passage branches from the exhaust passage, in which the particulate filter is arranged, upstream of the particulate filter via an exhaust branch portion, and joins the exhaust passage downstream of the particulate filter via an exhaust join portion. In the present embodiment, an opening of the changeover portion 71 in the side of the exhaust pipe 18 is the exhaust branch portion, and an opening of the changeover portion 71 in the side of the exhaust passage 73 is the exhaust joining portion.

In the exhaust pipe 18, an $SO_x$ trap unit 74 is arranged. In the second connecting portion 72*b*, a fuel supply unit 75 that can inject fuel when needed is arranged. Further, between the $SO_x$ trap unit 74 and the opening of the changeover portion 71 in the side of the exhaust pipe 18, an exhaust choke valve 76 is arranged. The exhaust choke valve will be explained in detail later.

Thus, the present device for purifying the exhaust gas has the very simple structure, can reverse the exhaust gas upstream side and the exhaust gas downstream side of the particulate filter by changing over the valve body 71*a* from one of the two shut-off positions to the other, and can make the exhaust gas bypass the particulate filter 70 when the valve body 71*a* is in the release position.

Further, the particulate filter requires a large opening area to facilitate the introduction of the exhaust gas. In the device, the particulate filter having a large opening area can be used without making it difficult to mount it on the vehicle as shown in FIGS. 2 and 3.

Figure 6A:
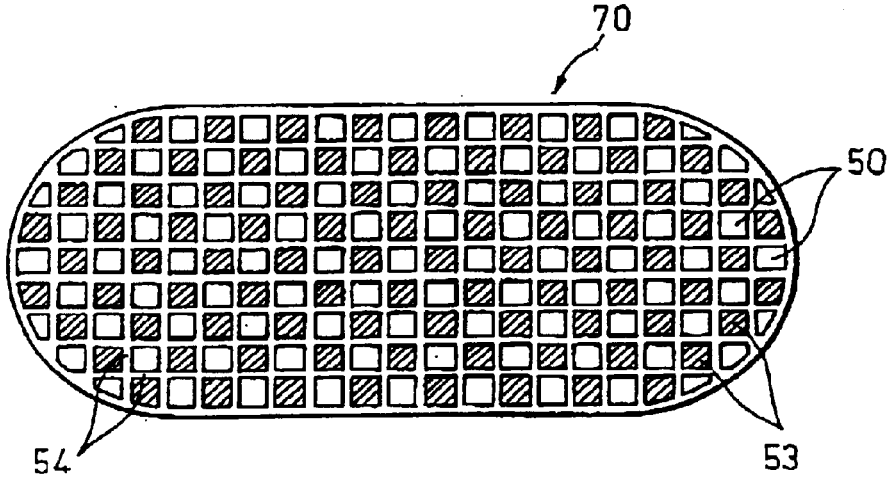
FIG. 6(A) is a front view showing the structure of the particulate filter.
Figure 6B:
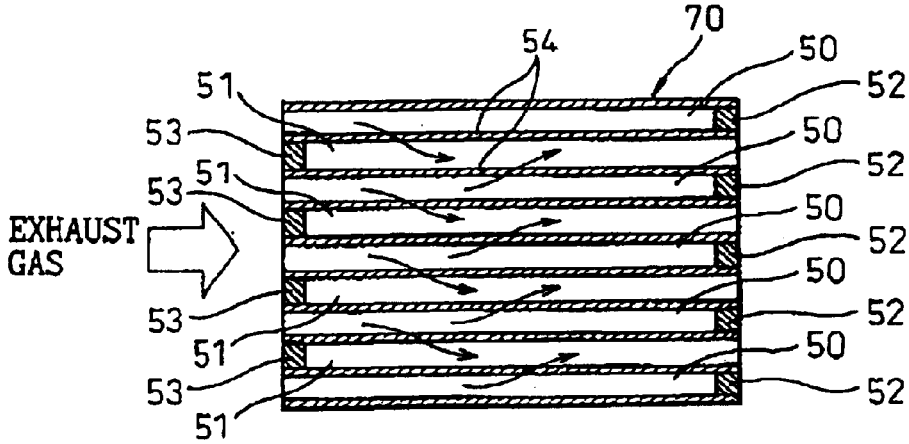
FIG. 6(B) is a side sectional view showing the structure of the particulate filter.

FIG. 6 shows the structure of the particulate filter 70, wherein FIG. 6(A) is a front view of the particulate filter 70 and FIG. 6(B) is a side sectional view thereof. As shown in these figures, the particulate filter 70 has an elliptic shape, and is, for example, a wall-flow-type of a honeycomb structure formed of a porous material such as cordierite, and has many spaces in the axial direction divided by many partition walls 54 extending in the axial direction. One of any two neighboring spaces is closed by a plug 53 on the exhaust gas downstream side, and the other one is closed by a plug 53 on the exhaust gas upstream side. Thus, one of the two neighboring spaces serves as an exhaust gas flow-in passage 50 and the other one serves as an exhaust gas flow-out passage 51, causing the exhaust gas to necessarily pass through the partition wall 54 as indicated by arrows in FIG. 6(B). The particulates contained in the exhaust gas are much smaller than the pores of the partition wall 54, but collide with and are trapped on the exhaust gas upstream side surface of the partition wall 54 and the pores surface in the partition wall 54. Thus, each partition wall 54 works as a trapping wall for trapping the particulates. In the present particulate filter 70, in order to oxidize and remove the trapped particulates, an active-oxygen releasing agent and a noble metal catalyst, which will be explained below, are carried on both side surfaces of the partition wall 54 and preferably also on the pore surfaces in the partition wall 54.

The active-oxygen releasing agent releases active-oxygen to promote the oxidation of the particulates and, preferably, takes in and holds oxygen when excessive oxygen is present in the surroundings and releases the held oxygen as active-oxygen when the oxygen concentration in the surroundings drops.

As the noble metal catalyst, platinum Pt is usually used. As the active-oxygen releasing agent, there is used at least one selected from alkali metals such as potassium K, sodium Na, lithium Li, cesium Cs, and rubidium Rb, alkali earth metals such as barium Ba, calcium Ca, and strontium Sr, rare earth elements such as lanthanum La and yttrium Y, and transition metals.

As an active-oxygen releasing agent, it is desired to use an alkali metal or an alkali earth metal having an ionization tendency stronger than that of calcium Ca, i.e., to use potassium K, lithium Li, cesium Cs, rubidium Rb, barium Ba, or strontium Sr.

Next, explained below is how the trapped particulates on the particulate filter are oxidized and removed by the particulate filter carrying such an active-oxygen releasing agent with reference to the case of using platinum Pt and potassium K. The particulates are oxidized and removed in the same manner even by using another noble metal and another alkali metal, an alkali earth metal, a rare earth element, or a transition metal.

In a diesel engine, combustion usually takes place in an excess air condition and, hence, the exhaust gas contains a large amount of excess air. That is, if the ratio of the air to the fuel supplied to the intake system and to the combustion chamber is referred to as an air-fuel ratio of the exhaust gas, the air-fuel ratio is lean. Further, NO is generated in the combustion chamber and, hence, the exhaust gas contains NO. Further, the fuel contains sulfur S and sulfur S reacts with oxygen in the combustion chamber to form $SO_2$. Accordingly, an exhaust gas containing excessive oxygen, $NO_x$ and $SO_2$ flows into the exhaust gas upstream side of the particulate filter 70.

Figure 7A:
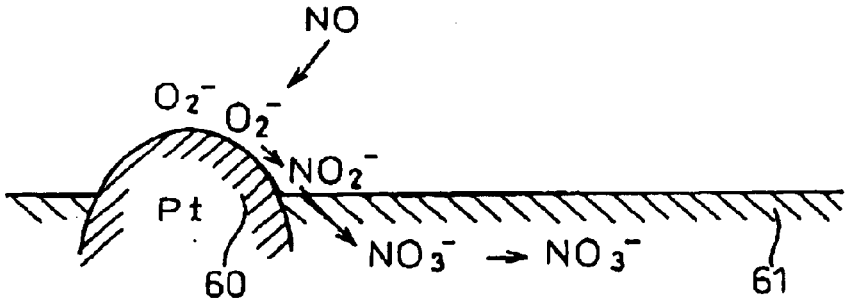
FIGS. 7(A) and 7(B) are views explaining the oxidizing action of the particulate.
Figure 7B:
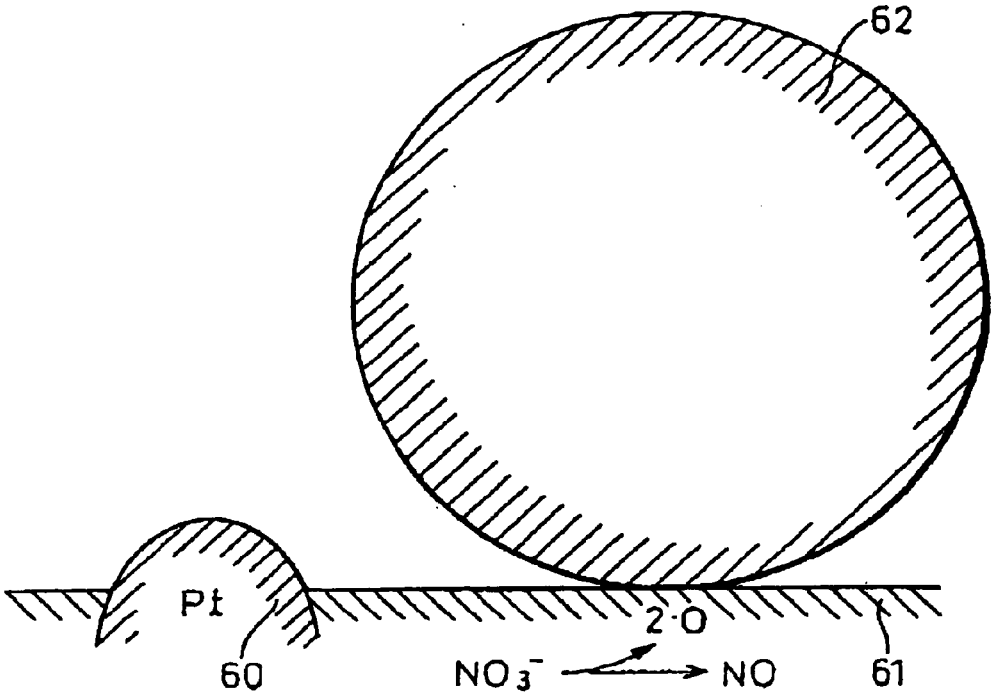

FIGS. 7(A) and 7(B) are enlarged views schematically illustrating the surface of the particulate filter 70 with which the exhaust gas comes in contact. In FIGS. 7(A) and 7(B), reference numeral 60 denotes a particle of platinum Pt and 61 denotes the active-oxygen releasing agent containing potassium K.

As described above, the exhaust gas contains a large amount of excess oxygen. When the exhaust gas contacts the exhaust gas contact surface of the particulate filter, oxygen $O_2$ adheres onto the surface of platinum Pt in the form of $O_2^-$ or $O^{2-}$ as shown in FIG. 7(A). On the other hand, NO in the exhaust gas reacts with $O_2^-$ or $O^{2-}$ on the surface of platinum Pt to produce $NO_2$ ($2NO+O_2 \rightarrow 2NO_2$). Next, a part of the produced $NO_2$ is absorbed in the active-oxygen releasing agent 61 while being oxidized on platinum Pt, and diffuses into the active-oxygen releasing agent 61 in the form of nitric acid ion $NO_3^-$ while being combined with potassium K to form potassium nitrate $KNO_3$ as shown in FIG. 7(A). Thus, in the present embodiment, $NO_x$ contained in the exhaust gas is absorbed in the particulate filter 70 and the amount thereof released into the atmosphere can be decreased, that is, the active-oxygen releasing agent also functions a $NO_x$ absorbent.

Further, the exhaust gas contains $SO_2$, as described above, and $SO_2$ also is absorbed in the active-oxygen releasing agent 61 due to a mechanism similar to that of the case of NO. That is, as described above, oxygen $O_2$ adheres to the surface of platinum Pt in the form of $O_2^-$ or $O^{2-}$, and $SO_2$ in the exhaust gas reacts with $O_2^-$ or $O^{2-}$ on the surface of platinum Pt to produce $SO_3$. Next, a part of the produced $SO_3$ is absorbed in the active-oxygen releasing agent 61 while being oxidized on the platinum Pt and diffuses in the active-oxygen releasing agent 61 in the form of sulfuric acid ion $SO_4^{2-}$ while being combined with potassium K to produce potassium sulfate $K_2SO_4$. Thus, potassium nitrate $KNO_3$ and potassium sulfate $K_2SO_4$ are produced in the active-oxygen releasing agent 61.

The particulates in the exhaust gas adhere to the surface of the active-oxygen releasing agent 61 carried by the particulate filter 70 as designated at 62 in FIG. 7(B). At this time, the oxygen concentration drops on the surface of the active-oxygen releasing agent 61 with which the particulates 62 contact. As the oxygen concentration drops, there occurs a difference in the concentration from the active-oxygen releasing agent 61 having a high oxygen concentration and, thus, oxygen in the active-oxygen releasing agent 61 tends to migrate toward the surface of the active-oxygen releasing agent 61 with which the particulates 62 contact. As a result, potassium nitrate $KNO_3$ produced in the active-oxygen releasing agent 61 is decomposed into potassium K, oxygen O and NO, whereby oxygen O migrates toward the surface of the active-oxygen releasing agent 61 with which the particulates 62 contact, and NO is emitted to the external side from the active-oxygen releasing agent 61. NO emitted to the external side is oxidized on platinum Pt on the downstream side and is absorbed again in the active-oxygen releasing agent 61. Of course, when an air-fuel ratio in the surroundings of the particulate filter 70 is stoichiometric or rich, active-oxygen and NO are also released from the active-oxygen releasing agent.

On the other hand, oxygen O migrating toward the surface of the active-oxygen releasing agent 61 with which the particulates 62 contact is the one decomposed from such compounds as potassium nitrate $KNO_3$. Oxygen O decomposed from the compound has a high level of energy and exhibits a very high activity. Therefore, oxygen migrating toward the surface of the active-oxygen releasing agent 61 with which the particulates 62 contact is active-oxygen O. Upon coming into contact with active-oxygen O, the particulates 62 are oxidized without producing luminous flame in a short time such as, for example, a few minutes or a few tens of minutes. Further, active-oxygen to oxidize the particulate 62 is also released when NO is absorbed in the active-oxygen releasing agent 61. That is, it can be considered that $NO_x$ diffuses in the active-oxygen releasing agent 61 in the form of nitric acid ion $NO_3^-$ while being combined with an oxygen atom and to be separated from an oxygen atom, and during this time, active-oxygen is produced. The particulate 62 is also oxidized by this active-oxygen. Further, the particulates adhered to the particulate filter 70 are not oxidized only by active-oxygen, but also by oxygen contained in the exhaust gas.

The higher the temperature of the particulate filter becomes, the more the platinum Pt and the active-oxygen releasing agent 61 are activated. Therefore, the higher the temperature of the particulate filter becomes, the larger an amount of active-oxygen O released from the active-oxygen releasing agent 61 per a unit time becomes. Further, naturally, the higher the temperature of particulate is, the easier the particulate is to oxidize. Therefore, the amount of particulate that can be oxidized and removed without producing luminous flame on the particulate filter per a unit time increases along with an increase of the temperature of the particulate filter.

Figure 8:
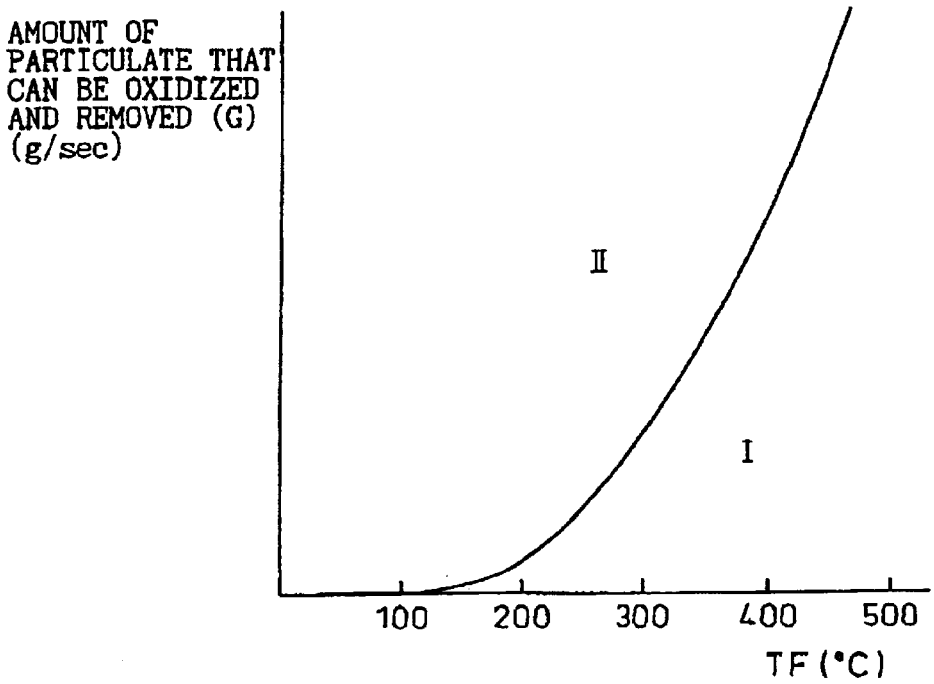
FIG. 8 is a view showing the relationship between the amount of particulates that can be oxidized and removed and the temperature of the particulate filter.

The solid line in FIG. 8 shows the amount of particulates (G) that can be oxidized and removed without producing luminous flame per a unit time. In FIG. 8, the abscissa represents the temperature (TF) of the particulate filter. Here, FIG. 8 shows the case that the unit time is 1 second, that is, the amount of particulates (G) that can be oxidized and removed per 1 second. However, any time such as 1 minute, 10 minutes, or the like can be selected as a unit time. For example, in the case that 10 minutes is used as a unit time, the amount of particulate (G) that can be oxidized and removed per a unit time represents the amount of particulate (G) that can be oxidized and removed in 10 minutes. In this case also, the amount of particulate (G) that can be oxidized and removed without producing luminous flame increases along with the increase of the temperature of particulate filter 70 as shown in FIG. 8.

Figure 9A:
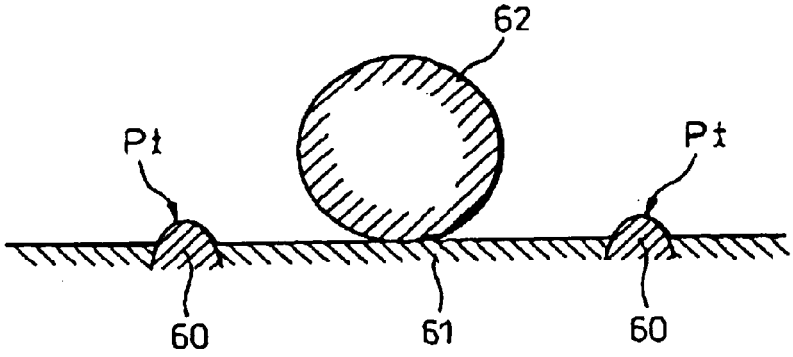
FIGS. 9(A), 9(B), and 9(C) are views explaining the depositing action of the particulate.
Figure 9B:
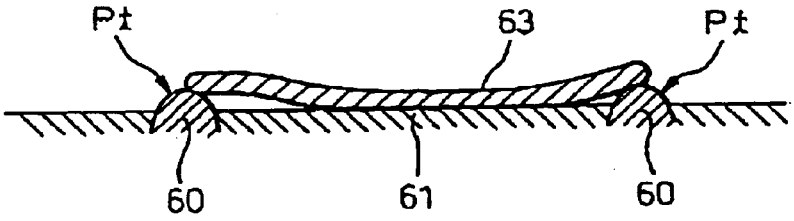
Figure 9C:
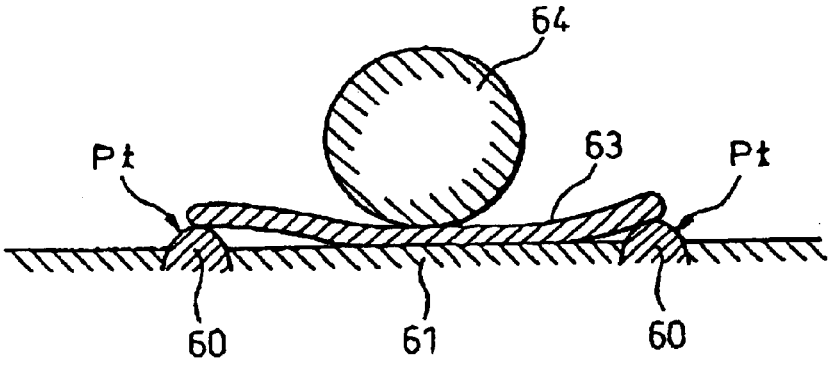

The amount of particulates emitted from the combustion chamber per a unit time is referred to as an amount of emitted particulates (M). When the amount of emitted particulate (M) is smaller than the amount of particulate (G) that can be oxidized and removed, for example, the amount of emitted particulate (M) per 1 second is smaller than the amount of particulate (G) that can be oxidized and removed per 1 second or the amount of emitted particulate (M) per 10 minutes is smaller than the amount of particulate (G) that can be oxidized and removed per 10 minutes, that is, in the area (I) of FIG. 8, the particulates emitted from the combustion chamber are all oxidized and removed successively without producing luminous flame on the particulate filter 70 for the short time. On the other hand, when the amount of emitted particulates (M) is larger than the amount of particulates that can be oxidized and removed (G), that is, in the area (II) of FIG. 8, the amount of active-oxygen is not sufficient for all particulates to be oxidized and removed successively. FIGS. 9(A) to (C) illustrate the manner of oxidation of the particulate in such a case.

That is, in the case that the amount of active-oxygen is lacking for oxidizing all particulates, when the particulate 62 adheres on the active-oxygen releasing agent 61, only a part of particulates is oxidized as shown in FIG. 9(A), and the other part of particulates that was not oxidized sufficiently remains on the exhaust gas upstream surface of the particulate filter when the state where the amount of active-oxygen is lacking continues, a part of particulates that was not oxidized remains on the exhaust gas upstream surface of the particulate filter successively. As a result, the exhaust gas upstream surface of the particulate filter is covered with the residual particulates 63 as shown in FIG. 9(B).

The residual particulate 63 is gradually transformed into carbonaceous matter that can hardly be oxidized. Further, when the exhaust gas upstream surface is covered with the residual particulate 63, the action of platinum Pt for oxidizing NO and SO2, and the action of the active-oxygen releasing agent 61 for releasing active-oxygen are suppressed. The residual particulates 63 can be gradually oxidized over a relative long period. However, as shown in FIG. 9(C), other particulates 64 deposit on the residual particulates 63 one after the other, and when the particulates are deposited so as to laminate, even if they are easily oxidized particulates, these particulates may not be oxidized as these particulates are separated away from platinum Pt or from the active-oxygen releasing agent. Accordingly, other particulates deposit successively on these particulates 64. That is, when the state where the amount of emitted particulate (M) is larger than the amount of particulate that can be oxidized and removed (G) continues, the particulates deposit to laminate on the particulate filter.

Thus, in the area (I) of FIG. 8, the particulates are oxidized and removed without producing luminous flame in the short time and in the area (II) of FIG. 8, the particulates are deposited to laminate on the particulate filter. Therefore, the deposition of the particulates on the particulate filter can be prevented if the relationship between the amount of emitted particulate (M) and the amount of particulate that can be oxidized and removed (G) is in the area (I). As a result, a pressure loss of the exhaust gas in the particulate filter hardly changes and is maintained at a minimum pressure loss value that is nearly constant. Thus, a decrease of the engine output can be maintained as low as possible. However, this is not always realized, and the particulates may deposit on the particulate filter if nothing is done.

Figure 10:
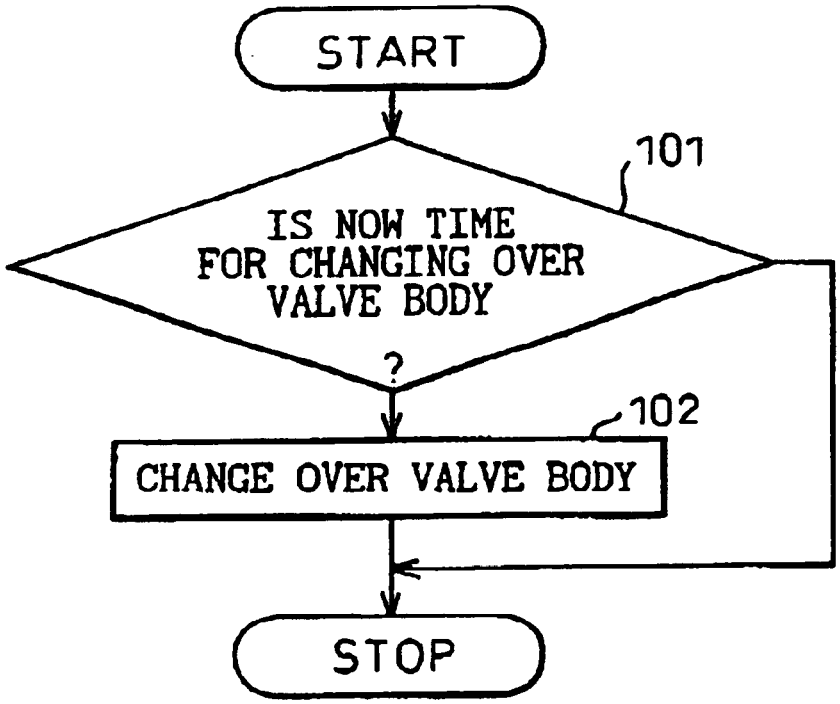
FIG. 10 is a flowchart for preventing the deposition of the particulate on the particulate filter.

In the present embodiment, to prevent the deposition of particulates on the particulate filter, the above electronic control unit 30 controls the valve body 71*a* according to a flowchart shown in FIG. 10. The present flowchart is repeated every a predetermined time. At step 101, it is determined if it is the time for changing over the valve body 71*a*. This time occurs every set period or a set integration running distance. When the result at step 101 is negative, the routine is stopped. However, when the result is positive, the routine goes to step 102. At step 102, the valve body 71*a* is pivoted from the present shut-off position to the other shut-off position, that is, the upstream side and the downstream side of the particulate filter are reversed.

Figure 11A:
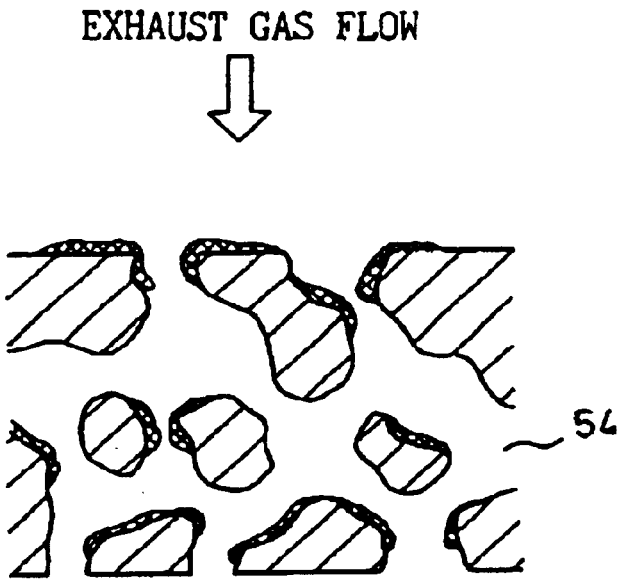
FIGS. 11(A) and 11(B) are enlarged sectional views of the partition wall of the particulate filter.
Figure 11B:
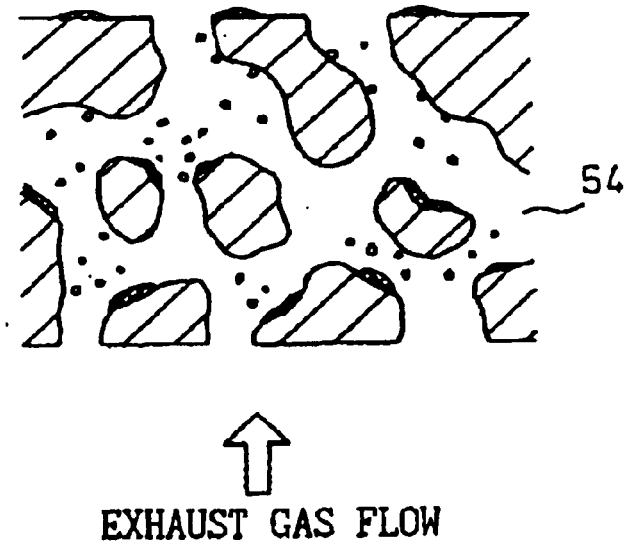

FIG. 11 is an enlarged sectional view of the partition wall 54 of the particulate filter. As mentioned above, the particulates collide with and are trapped by the exhaust gas upstream surface of the partition wall 54 and the exhaust gas opposing surface in the pores therein, i.e., one of the trapping surfaces of the partition wall 54, and are oxidized and removed by active-oxygen released from the active-oxygen releasing agent. However, the engine can be operated in the area (II) of FIG. 8 during the set period or the set integration running distance and thus the particulates can remain due to the insufficient oxidization as shown in FIG. 11(A) by grid lines. At this stage, the exhaust resistance of the particulate filter does not have a bad influence on the traveling of the vehicle. However, if more particulates deposit, problems in which the engine output drops considerably, the large amount of deposited particulates ignites and burns at once to melt the particulate filter by the burned heat thereof, and the like occur. If at this stage, the upstream side and the downstream side of the particulate filter are reversed as mentioned above, no particulates deposit again on the residual particulates on one of the trapping surfaces of the partition wall and thus the residual particulates can be gradually oxidized and removed by active-oxygen released from the one of the trapping surfaces. Further, in particular, the residual particulates in the pores in the partition wall are easily smashed into fine pieces by the exhaust gas flow in the reverse direction as shown in FIG. 11(B), and they mainly move through the pores toward the downstream side.

Accordingly, many of the particulates smashed into fine pieces diffuse in the pore in the partition wall, and they contact directly the active-oxygen releasing agent carried on the pores surface and are oxidized and removed are improved. Thus, if the active-oxygen releasing agent is also carried on the pores surface in the partition wall, the residual particulates can be very easily oxidized and removed. On the other trapping surface that is now on the upstream side as the flow of the exhaust gas is reversed, i.e., the exhaust gas upstream surface of the partition wall 54 and the exhaust gas oppose surface in the pores therein to which the exhaust gas mainly impinges (of the oppose side of one of the trapping surfaces), the particulates in the exhaust gas adhere newly thereto and are oxidized and removed by active-oxygen released from the active-oxygen releasing agent. In this oxidization, a part of the active-oxygen released from the active-oxygen releasing agent on the other trapping surface moves to the downstream side with the exhaust gas, and it is made to oxidize and remove the particulates that still remain on one of the trapping surfaces despite of the reversal flow of the exhaust gas.

That is, the residual particulates on one of the trapping surfaces is exposed to not only active-oxygen released from this trapping surface but also the remainder of the active-oxygen used for oxidizing and removing the particulates on the other trapping surface by reversing the flow of the exhaust gas. Therefore, even if some degrees of particulate deposits to laminate on one of the trapping surfaces of the partition wall of the particulate filter when reversing of the exhaust gas, active-oxygen arrives at the deposited particulate and no particulates deposit again on the deposited particulate due to the reversal flow of the exhaust gas and thus the deposited particulate is gradually oxidized and removed and it can be oxidized and removed sufficiently for some period until the next reversing of the exhaust gas. Of course, by alternately using the one trapping surface and the other trapping surface of the partition wall, the amount of trapped particulate on each trapping surface is smaller than that of a particulate filter in which the single trapping surface always traps the particulates. This facilitates oxidizing and removing the trapped particulates on the trapping surface.

The valve body may not be changed regularly over every set period or set integration running distance, but may be changed over irregularly. The valve body may be changed over every engine deceleration. When it is to be determined that the engine is being decelerating, the detection of the operation in which the driver intends to decelerate the engine, for example, the release of the accelerator pedal, the depression of the brake pedal, the fuel-cut or the like can be utilized. In the present embodiment, when the valve body 71*a* is changed over from one of the first and second shut-off positions to the other, the valve body 71*a* passes through the release position and at this time, a part of the exhaust gas bypasses the particulate filter 70. However, in the engine deceleration, an amount of injected fuel is very small or a fuel-cut is carried out and thus, particulates almost no are produced. Accordingly, a large amount of particulates is not emitted into the atmosphere.

Besides, when an amount of particulates deposited on the particulate filter reaches a predetermined amount, the valve body may be changed over. In an estimation of an amount of deposited particulates, the difference in pressure between the exhaust gas immediately upstream side and the exhaust gas immediately downstream side of the particulate filter 70 can be utilized. This difference in pressure increases along with an increase of an amount of deposited particulates. Further, electric resistance on a predetermined partition wall of the particulate filter may be utilized. This electric resistance drops along with an increase of an amount of deposited particulates. A transmissivity or reflectivity of light on a predetermined partition wall of the particulate filter may be utilized. The transmissivity or reflectivity drops along with an increase of an amount of deposited particulates. Besides, on the basis of the graph in FIG. 8, the difference (M−G) between the amount of emitted particulates (M) estimated by the current engine operating condition and the amount of particulates that can be oxidized and removed (G) estimated by the current engine operating condition may be integrated as an amount of deposited particulates.

Further, when the air-fuel ratio of the exhaust gas is made rich, i.e., when the oxygen concentration in the exhaust gas is decreased, active-oxygen O is released at one time from the active-oxygen releasing agent 61 to the outside. Therefore, the deposited particulates become particulates that are easily oxidized by the active-oxygen 0 released at one time and thus they can be easily oxidized and removed. On the other hand, when the air-fuel ratio is maintained lean in the surroundings of the particulate filter, the surface of platinum Pt is covered with oxygen, that is, oxygen contamination is caused. When such oxygen contamination is caused, the oxidization action to $NO_x$ of platinum Pt drops and thus the absorbing efficiency of $NO_x$ drops. Therefore, the amount of active-oxygen released from the active-oxygen releasing agent 61 decreases. However, the air-fuel ratio is made rich, oxygen on the surface of Platinum Pt is consumed and thus the oxygen contamination is cancelled. Accordingly, when the air-fuel ratio is changed over from rich to lean again, the oxidization action to $NO_x$ becomes strong and thus the absorbing efficiency rises. Therefore, the amount of active-oxygen released from the active-oxygen releasing agent 61 increases. Thus, when the air-fuel ratio is maintained lean, if the air-fuel ratio is changed over from lean to rich once in a while, the oxygen contamination of platinum Pt is cancelled every this time and thus the amount of released active-oxygen increases when the air-fuel ratio is lean. Therefore, the oxidization action of the particulate on the particulate filter 70 can be promoted. Further, the result of the cancellation of the oxygen contamination is that the reducing agent burns and thus the burned heat thereof raises the temperature of the particulate filter. Therefore, the amount of particulates that can be oxidized and removed of the particulate filter increases and thus the residual and deposited particulates are oxidized and removed more easily. If the air-fuel ratio in the exhaust gas is made rich immediately after the upstream side and the downstream side of the particulate filter is reversed by the valve body 71*a*, the other trapping surface on which the particulates do not remain releases active-oxygen more easily than the first trapping surface. Thus, the larger amount of released active-oxygen can oxidize and removed the residual particulates on the one trapping surface more certainly. Of course, the air-fuel ratio of the exhaust gas may be sometimes made rich regardless the changeover of the valve body 71*a*. Therefore, the particulates hardly remain or deposit on the particulate filter.

As a manner to make the air-fuel ratio rich, for example, low temperature combustion (refer to Japanese Patent No.3116876) may be carried out. The low temperature combustion can be carried out in an internal combustion engine in which, when an amount of inert gas in the combustion chamber is gradually increased, an amount of produced soot gradually increases and reaches a peak amount. In the low temperature combustion, an amount of inert gas in the combustion chamber is made larger than the amount of the inert gas when an amount of produced soot becomes the peak amount, and thus the temperature of the fuel and the gas around the fuel is suppressed to lower than a temperature that soot is produced, and therefore the production of soot is suppressed in the combustion chamber. Further, to make the air-fuel ratio of the exhaust gas rich, the combustion air-fuel ratio may be merely made rich. Further, in addition to the main fuel injection in the compression stroke, the fuel injector may inject fuel into the cylinder in the exhaust stroke or in the expansion stroke (post-injection), or may inject fuel into the cylinder in the intake stroke (pre-injection). of course, an interval between the post-injection or the pre-injection and the main fuel injection may not be provided. Further, fuel may be supplied to the exhaust system.

Thus, when the above-mentioned active-oxygen releasing agent is carried on the particulate filter 70, the particulates trapped on the particulate filter 70 can be oxidized and removed and $NO_x$ in the exhaust gas, of which emission into the atmosphere is undesirable, can be absorbed in the particulate filter. By the way, the ability for absorbing $NO_x$ in the active-oxygen releasing agent has a limit. If the ability saturates, the active-oxygen releasing agent cannot newly absorb $NO_x$ in the exhaust gas and thus $NO_x$ cannot be favorably purified. Accordingly, before the ability saturates, $NO_x$ must be released from the active-oxygen releasing agent. Namely, before a current amount of $NO_x$ absorbed in the particulate filter 70 reaches the limit amount of $NO_x$ that can be absorbed therein, a regeneration process of the particulate filter, in which $NO_x$ is released therefrom and the released $NO_x$ is reduced and purified, is required. Thus, if $NO_x$ is released at one time, a large amount of active-oxygen also is released simultaneously. This is advantage for oxidizing and removing the trapped particulates.

For this purpose, a current amount of $NO_x$ absorbed in the particulate filter 70 must be estimated. In the above-mentioned diesel engine, the low temperature combustion is carried out in low engine load operating conditions and the normal combustion is carried out in high engine load operating conditions. In the present embodiment, an amount of $NO_x$ absorbed in the particulate filter per a unit time (A) in the low temperature combustion can be determined as functions of a required load (L) and an engine speed (N) and thus a map of the amounts of $NO_x$ (A) absorbed in the low temperature combustion is predetermined. An amount of $NO_x$ absorbed in the particulate filter per a unit time (B) in the normal combustion can be determined as functions of a required load (L) and an engine speed (N) and thus a map of the amounts of $NO_x$ (B) absorbed in the normal combustion is predetermined. Therefore, a current amount of $NO_x$ absorbed in the particulate filter can be estimated to integrate these amounts of $NO_x$ absorbed in the particulate filter per a unit time (A) and (B) Here, when the low temperature combustion takes place in a rich air-fuel ratio, the absorbed $NO_x$ is released and thus an amount of $NO_x$ absorbed in the particulate filter per a unit time (A) become a minus value. In the present embodiment, when the estimated amount of $NO_x$ absorbed in the particulate filter becomes more than a predetermined permissible value, the low temperature combustion is carried out at the stoichiometric air-fuel ratio or a rich air-fuel ratio, fuel is injected into the cylinder in the expansion stroke, in the exhaust stroke, or the like, and thus the air-fuel ratio in the surrounding atmosphere of the particulate filter 70 is made stoichiometric or rich to generate the particulate filter. This condition is maintained at least till the generation of the particulate filter is finished. The smaller the air-fuel ratio in the surrounding atmosphere is, the shorter the period in which this condition is maintained becomes.

Figure 12:
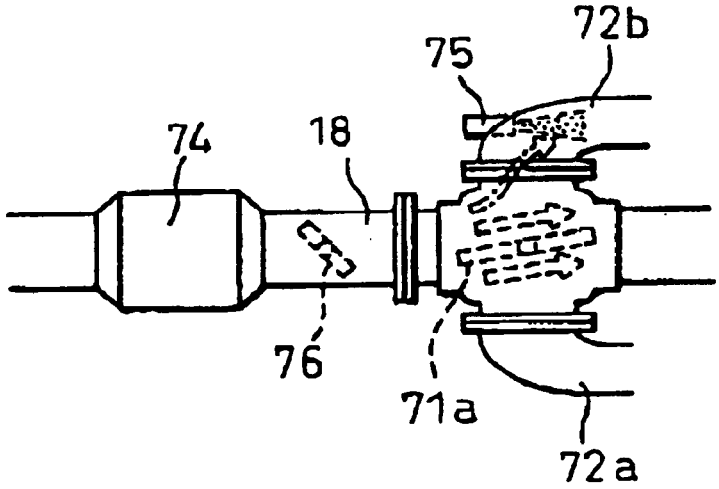
FIG. 12 is a view showing the position of the valve body in the changeover portion when $NO_x$ is released from the particulate filter.

In the present embodiment, as mentioned above, the fuel supply unit 75 is arranged on the second connecting portion 72*b* and thus the fuel supply unit 75 may inject fuel to regenerate the particulate filter 70. In this case, as shown in FIG. 12, the valve body 71*a* is pivoted slightly from the release position in the direction of the second shut-off position. Therefore, the valve body 71*a* does not shut off the changeover portion 71 and thus the exhaust gas mainly bypasses the particulate filter 70. However, a part of the exhaust gas flows in the second connecting portion 72*b*. Thus, the fuel supply unit 75 injects fuel into this slight amount of exhaust gas and the injected fuel flows in the particulate filter 70 therewith. Therefore, with a relatively small amount of fuel, an air-fuel ratio in the surrounding atmosphere of the active-oxygen releasing agent can be made sufficiently rich. Accordingly, $NO_x$ is released from the particulate filter 70 and the released $NO_x$ is reduced and purified. The fuel supply unit 75 preferably injects fuel such that the injected fuel does not stick on the inside surface of the second connecting portion 72*b* and all of the injected fuel is used to make the air-fuel ratio in the surrounding atmosphere of the active-oxygen releasing agent on the particulate filter 70 rich. Besides, in the regeneration process of the particulate filter 70, the valve body 71*a* may assume the release position. Therefore, the exhaust gas does not flow in the particulate filter 70 and the fuel injected from the fuel supply unit 75 is supplied to the particulate filter by its inertia force.

If the fuel is supplied to the particulate filter 70 when the valve body 71*a* assumes the second shut-off position, a large amount of exhaust gas passes through the particulate filter 70 and thus the fuel with the large amount of exhaust gas easily passes through the particulate filter. Thus, if a large amount of fuel is not supplied, the air-fuel ratio in the surrounding atmosphere will not become rich and the particulate filter 70 will not be regenerated. The large amount of supplied fuel increases the fuel consumption while the fuel merely passes through the particulate filter 70 is emitted into the atmosphere to deteriorate the exhaust emission.

By the way, the active-oxygen releasing agent does not absorb only $NO_x$, but also absorbs $SO_x$ in the exhaust gas. $SO_x$ is absorbed in the form of sulfate and sulfate can release active oxygen due to a mechanism similar to that of the case of nitrate. However, sulfate is stable and if the air-fuel ratio in the surrounding atmosphere is made rich, sulfate is hardly released from the particulate filter. In fact, sulfate remains on the particulate filter and thus an amount of absorbed sulfate increase gradually. An amount of nitrate or sulfate that can be absorbed in the particulate filter has a limit. If an amount of absorbed sulfate in the particulate filter increases (this is referred to sulfur poisoning below), an amount of nitrate that can be absorbed in the particulate filter decreases. Finally, the particulate filter cannot absorb $NO_x$. This is a problem in purifying $NO_x$.

In the present embodiment, the $SO_x$ trap unit 74 is arranged on the exhaust pipe 18 that positions upstream of reversing means, i.e., the changeover portion 71. Therefore, the $SO_x$ trap unit traps $SO_x$ in the exhaust gas at the position that is always upstream of the particulate filter 70, and thus the sulfur poisoning of the particulate filter 70 can be prevented.

The $SO_x$ trap unit 74 carries a $SO_x$ absorbing agent and preferably an oxidation catalyst such as a noble catalyst on, for example, a carrier having a honeycomb structure. A material as same as that of the active-oxygen releasing agent can be used as the $SO_x$ absorbing agent. In particular, barium Ba or lithium Li is preferably used. The $SO_x$ absorbing agent can absorb $SO_x$ due to a mechanism similar to that as mentioned above. Of course, also in the $SO_x$ trap unit 74, the amount of $SO_x$ that can be absorbed has a limit. Before the ability for absorbing $SO_x$ saturates, $SO_x$ must be released from the $SO_x$ trap unit.

When an amount of $SO_x$ absorbed in the $SO_x$ trap unit 74 increases and thus reaches a predetermined value, a regeneration process of the sulfur poisoning, in which the absorbed $SO_x$ is released, must be carried out. In the determination of the time for recovering, when an amount of fuel consumed reaches a predetermined amount, it can be determined that the regeneration process of the sulfur poisoning is required.

When the regeneration process of the sulfur poisoning is required, the above mentioned low temperature combustion is carried out such that the exhaust gas includes a relative large amount of reduction material such as HC or CO, fuel is injected into the cylinder in the expansion stroke or in the exhaust stroke, or fuel is injected into the exhaust system at the upstream side of the $SO_x$ trap unit 74. Therefore, sufficient amounts of oxygen and reduction material such as unburned fuel are supplied to the $SO_x$ trap unit and the reduction material burns due to the oxidation ability of the $SO_x$ trap unit.

Thus, the temperature of the $SO_x$ trap unit rises about 600 degrees C. and the stable sulfate can be released as $SO_x$ when the air-fuel ratio in the surrounding atmosphere is made stoichiometric or rich and the oxygen concentration drops. Besides, if lithium Li is used as the $SO_x$ absorbing agent, $SO_x$ can be released at a temperature lower than 600 degrees C. If the temperature of the $SO_x$ trap unit rises over 700 degrees C., the oxidation catalyst such as platinum Pt carried thereon sinters and thus the oxidation function thereof drops. Therefore, the temperature of the exhaust gas immediately downstream of the $SO_x$ trap unit 74 is monitored and it is preferable to prevent the sintering of the oxidation catalyst. In the regeneration process of the sulfur poisoning of the $SO_x$ trap unit, the valve body 71*a* of the changeover portion 71 is set the release position. Therefore, the released $SO_x$ from the $SO_x$ trap unit bypasses the particulate filter 70 and the released $SO_x$ is not absorbed in the active-oxygen releasing agent of the particulate filter again. When the air-fuel ratio in the surrounding atmosphere is made rich for a predetermined time after the temperature of the $SO_x$ trap unit is made high, it can be determined that the regeneration process of the sulfur poisoning finishes and the combustion air-fuel ratio is returned to the normal air-fuel ratio.

By the way, a soluble organic fraction SOF is also contained in the exhaust gas. SOF has an adhesion property and adheres the particulates to each other on the particulate filter, and thus makes the particulates become a large mass. This makes it difficult to oxidize and remove the particulates on the particulate filter and to keep the filter meshes open. If the $SO_x$ trap unit carries a catalyst having an oxidation function, SOF in the exhaust gas can be burned at the upstream side of the particulate filter 70 and thus the blocking of the filter meshes can be prevented.

As mentioned above, if the upstream side and the downstream side of the particulate filter 70 are reversed, it is easier to oxidize and remove the particulates trapped on the particulate filter 70. However, this does not limit the present invention. For example, if the operating area of the above low temperature combustion is made large, the exhaust gas is made to bypass the particulate filter when needed, or the like, such that an amount of particulate emitted from the cylinder per unit time is controlled not to become larger than an amount of particulate that can be oxidized and removed per unit time on the basis of the temperature of the particulate filter, the trapped particulates can be favorably oxidized and removed without the reversing means.

However, the $SO_x$ trap unit 74 is provided to suppress the sulfur poisoning and thus it must be prevented that a large amount of $SO_x$ flows in the particulate filter 70 when $SO_x$ is released from the $SO_x$ trap unit. Accordingly, in the present invention, bypass means by which the exhaust gas including a large amount of $SO_x$ can bypass the particulate filter 70 is required. Of course, the bypass means may be integrated with the reversing means as mentioned above and may have a usual bypass passage which branches from the exhaust passage in which the particulate filter is arranged via a branch portion in the upstream side of the particulate filter and joins to the exhaust passage via a joining portion in the downstream side of the particulate filter.

By the way, an exhaust brake to produce an engine brake is used in addition to the normal brake unit to decelerate a particularly large vehicle or the like. The exhaust brake produces the engine brake, to increase the exhaust resistance, by choking the exhaust system with the exhaust choke valve. Thus, in an internal combustion engine comprising an exhaust brake, an exhaust choke valve must be arranged in the exhaust system. In the present embodiment, as mentioned above, the exhaust choke valve 76 is arranged between the $SO_x$ trap unit 74 and the opening of the changeover portion 71 in the exhaust pipe 18 side, i.e., the branch portion of the bypass passage.

The exhaust choke valve 76 is preferably arranged to make the volume of the exhaust system upstream of the exhaust choke valve 76 small. If the exhaust choke valve 76 is arranged downstream of the particulate filter 70 that has a relative large volume, a relative long period is required until the engine brake is actually produced to increase the whole pressure in the exhaust passage upstream of the exhaust choke valve 76 from the time when the exhaust choke valve 76 shuts off or chokes the exhaust passage. In the present embodiment, the exhaust choke valve 76 is arranged upstream of the particulate filter 70, i.e., upstream of the branch portion of the bypass passage and thus the volume of exhaust passage upstream of the exhaust choke valve is relative small. Accordingly, when the exhaust choke valve shuts off or chokes the exhaust passage, the engine brake can be produced after a relative short period.

By the way, in the $SO_x$ trap unit 74, $SO_x$ is mainly trapped on the exhaust gas upstream portion and thus the sulfur poisoning is mainly caused in the exhaust gas upstream portion of the $SO_x$ trap unit 74. Accordingly, when the regeneration process of the sulfur poisoning is carried out in the $SO_x$ trap unit 74, the $SO_x$ trap unit 74 must be heated such that the temperature of the exhaust gas upstream portion reaches the desired temperature. As mentioned above, oxygen and a reduction material are supplied to the $SO_x$ trap unit 74, the reduction material is burned due to the oxidation ability of the $SO_x$ trap unit, and thus the temperature of the $SO_x$ trap unit raises. The burning of the reduction material also is mainly caused in the exhaust gas upstream portion of the sox trap unit. However, at this time, if a large amount of exhaust gas passes through the $SO_x$ trap unit 74, the burned heat thereof immediately transfers to the exhaust gas downstream portion with the large amount of exhaust gas and is discharged from the $SO_x$ trap unit after heating of the exhaust gas downstream portion. Thus, although the temperature of the exhaust gas downstream portion of the $SO_x$ trap unit favorably rises, the temperature of the exhaust gas upstream portion hardly rises.

Accordingly, to make the temperature of the exhaust gas upstream portion, in which the sulfur poisoning is caused, of the $SO_x$ trap unit 74 the desired temperature, the burned heat taken by the exhaust gas is considered and a large amount of reduction material such as unburned fuel must be supplied to the $SO_x$ trap unit 74 such that a large amount of burned heat is produced. Thus, an energy consumption to make the temperature of the $SO_x$ trap unit 74 the desired temperature can be decreased to smaller than that to make the temperature of the particulate filter 70 having a large volume the desired temperature, but is still relatively large. In the present embodiment, to decrease this energy consumption, the exhaust choke valve 76 for the exhaust brake arranged downstream of the $SO_x$ trap unit 74 is operated and thus an amount of exhaust gas passing, through the $SO_x$ trap unit can be decreased when the regeneration of the sulfur poisoning is carried out.

Therefore, if a small amount of reduction material is supplied to the $SO_x$ trap unit 74, the reduction material mainly burns on the exhaust gas upstream portion of the $SO_x$ trap unit 74 and thus the burned heat thereof is not almost taken by the exhaust gas, but favorably heats the exhaust gas upstream portion. Besides, a part of the reduction material reaches the exhaust gas downstream portion and burns thereon while a part of the burned heat on the exhaust gas upstream portion also transfer thereto with the exhaust gas, and thus the exhaust gas downstream portion of the $SO_x$ trap unit 74 also is heated to the desired temperature. When an amount of exhaust gas passing through the $SO_x$ trap unit is small, an amount of burned heat discharged from the $SO_x$ trap unit with the exhaust gas also becomes small. Therefore, the burned heat of the reduction material can be utilized effectively for raising the temperature of the $SO_x$ trap unit. Thus, the temperature of whole of the $SO_x$ trap unit can be raised to the desired temperature by using of a relative small amount of reduction material, and thus the energy consumption for raising the temperature of the $SO_x$ trap unit can be decreased. Also, in the case where the exhaust gas upstream portion of the $SO_x$ trap unit is heated by an electric heater, if an amount of exhaust gas passing through the $SO_x$ trap unit 74 is decreased, an amount of heat discharged from the $SO_x$ trap unit with the exhaust gas becomes small and thus the energy consumption can be decreased.

Thus, in the present embodiment, the exhaust choke valve 76 arranged for the exhaust brake is utilized to decrease the energy for raising the temperature of the $SO_x$ trap unit when the regenerating of the sulfur poisoning is carried out. If the regeneration of the sulfur poisoning is carried out in engine decelerations, the exhaust choke valve 76 almost shuts off the exhaust passage to produce a large engine brake and the burned heat of the reduction material in the $SO_x$ trap unit 74 is not almost discharged from the $SO_x$ trap unit 74. Thus, the temperature of the $SO_x$ trap unit 74 can be raised very effectively. In this case, the reduction material is hardly supplied to the $SO_x$ trap unit 74 by the exhaust gas and thus it is preferable that a fuel supply unit that can supply a reduction material such as fuel directly to the $SO_x$ trap unit 74 is provided. When the regeneration of the sulfur poisoning of the $SO_x$ trap unit 74 is carried out in other than engine decelerations, it is undesirable for the engine operation that the exhaust passage is almost shut off by the exhaust choke valve 76. Accordingly, it is desirable that the exhaust choke valve 74 is operated to the choking side and an amount of exhaust gas is decreased such that a bad influence on the engine operation is not caused.

As mentioned above, when the regeneration of the sulfur poisoning of the $SO_x$ trap unit 74 is carried out, the exhaust gas is made to bypass the particulate filter such that the sulfur poisoning of the particulate filter 70 is not caused by the $SO_x$ released from the $SO_x$ trap unit. Namely, at this time, the exhaust gas almost does not pass through the particulate filter 70. Accordingly, at this time, the regeneration process of the particulate filter 70 may be carried out by using of the fuel supply unit 75 as mentioned above. Therefore, opportunities, in which the valve body 71*a* is made the vicinity of the release position for the regeneration process, decreases and thus it can be prevented that lives of the valve body 71*a* and the actuator thereof are made shorter.

In the case where the regeneration process of the particulate filter 70 is carried out during the regeneration of the sulfur poisoning of the $SO_x$ trap unit 74, if the valve body 71*a* assumes the release position, the exhaust gas almost does not flow in the particulate filter 70 and thus the fuel supply unit 75 must supply the fuel directly to the particulate filter 70 with its inertia force without the use of the exhaust gas. On the other hand, in this case, if the valve body 71*a* is slightly pivoted to the second shut-off position side as shown in FIG. 28, a slight amount of exhaust gas flows in the particulate filter 70 and thus the fuel injected by the fuel supply unit 75 can be led to the particulate filter with the exhaust gas. At this time, the $SO_x$ released from the $SO_x$ trap unit 74 flows in the particulate filter. However, the amount of $SO_x$ included in the slight amount of exhaust gas is small and thus no problem occurs.

Thus, in the present embodiment, when $SO_x$ is released in the regeneration of the sulfur poisoning of the $SO_x$ trap unit, the exhaust choke valve 76 is operated to an amount of exhaust gas passing through the $SO_x$ trap unit 74 decreases and the valve body 71*a* is made the release position or pivoted slightly from the release position to the second shut-off position side. Thus, when the exhaust gas mainly bypasses the particulate filter, $NO_x$ is released from the particulate filter 70. Besides, in engine decelerations, the exhaust choke valve 76 almost shut off the exhaust passage to produce the engine brake. At this time, $SO_x$ is released to heat favorably the $SO_x$ trap unit and the valve body 71*a* is made the release position or is pivoted slightly from the release position to the second shut-off position side to make the released $SO_x$ bypass the particulate filter. Simultaneously, the regeneration process of the particulate filter 70 may be carried out to release $NO_x$ therefrom. Of course, it is not needed that the regeneration of the sulfur poisoning of the $SO_x$ trap unit and the regeneration process of the particulate filter are carried out every engine deceleration and thus when a period between engine decelerations is short, the regeneration of the sulfur poisoning of the $SO_x$ trap unit and the regeneration process of the particulate filter may not be carried out.

In the present embodiment, the exhaust choke valve 76 is arranged downstream of the $SO_x$ trap unit 74 and immediately upstream of the exhaust pipe 18 side opening of the changeover portion 71, i.e., the upstream side opening of the changeover portion 71. Accordingly, as mentioned above, the exhaust choke valve 76 can be utilized to decrease the energy for raising the temperature of the $SO_x$ trap unit, while in case where the actuators of the exhaust choke valve 76 and the valve body 71*a* of the changeover portion 71 utilize, for example, a negative pressure, the exhaust choke valve 76 and the changeover portion 71 are close each other and thus a common negative pressure tank can be used for the two actuators.

By the way, when $SO_3$ exists, calcium Ca in the exhaust gas forms calcium sulfate $CaSO_4$ as ash that remains on the particulate filter. To prevent the meshes blocking of the particulate filter caused by calcium sulfate $CaSO_4$, an alkali metal or an alkali earth metal having an ionization tendency stronger than that of calcium Ca, such as potassium K may be used as the active-oxygen releasing agent 61. Therefore, $SO_3$ diffused in the active-oxygen releasing agent 61 is combined with potassium K to form potassium sulfate $K_2SO_4$ and thus calcium Ca is not combined with $SO_3$ but passes through the partition walls of the particulate filter. Accordingly, the meshes of the particulate filter are not blocked by the ash. Thus, it is desired to use, as the active-oxygen releasing agent 61, an alkali metal or an alkali earth metal having an ionization tendency stronger than calcium Ca, such as potassium K, lithium Li, cesium Cs, rubidium Rb, barium Ba or strontium Sr.

Figure 13:
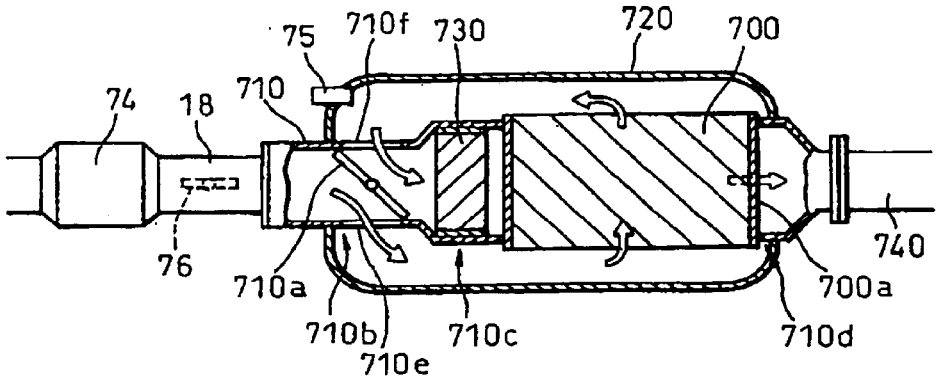
FIG. 13 is a plan view showing near the changeover portion and the particulate filter in the exhaust system that are different from those in FIG. 2.
Figure 14:
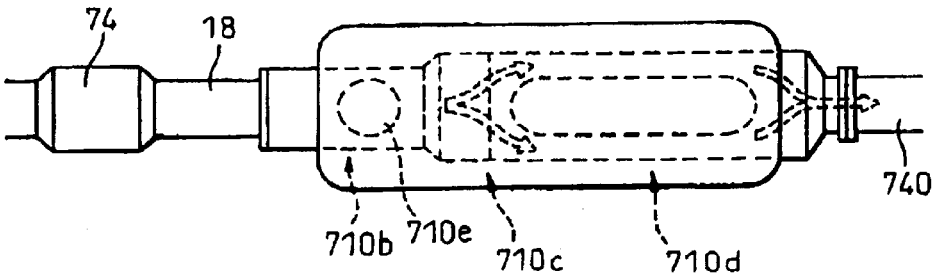
FIG. 14 is a side view of FIG. 13.
Figure 15:
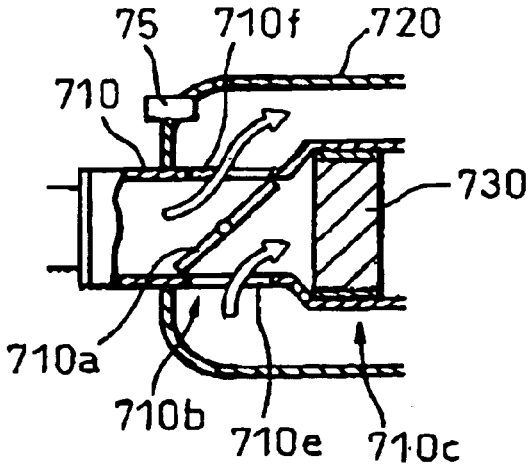
FIG. 15 is a view showing the other shut-off position of the valve body in the changeover portion that is different from that in FIG. 13.
Figure 16:
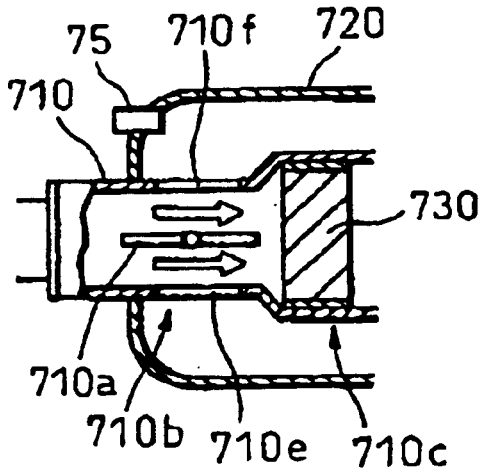
FIG. 16 is a view showing the release position of the valve body in the changeover portion.

FIG. 13 is a sectional view showing another device for purifying the exhaust gas, and FIG. 14 is a side view of FIG. 13. FIG. 15 is a sectional view showing the other shut-off position of the valve body that is different from that in FIG. 13, and FIG. 16 is a sectional view showing the release position of the valve body. The present device for purifying the exhaust gas has a center pipe member 710 and a cover member 720 surrounding the center pipe member 710. The upstream portion of the center pipe member 710 is connected to the downstream side of the exhaust manifold 17 via the exhaust pipe 18. The downstream portion of the center pipe member 710 is connected to the downstream exhaust pipe 740 that emits the exhaust gas into the atmosphere via a muffler. The $SO_x$ trap unit 74 as same as that of the device for purifying the exhaust gas shown in FIGS. 2 and 3 is arranged on the exhaust pipe 18. The exhaust choke valve 76 is arranged downstream of the $SO_x$ trap unit. The center pipe member 710 comprises the upstream portion 710*b* in which the valve body 710*a* is arranged, the central portion 710*c* that positions immediately downstream of the upstream portion 710*b*, and the downstream portion 710*d* that positions immediately downstream of the central portion 710*c*.

On the side surface of the upstream portion 710*b*, the first opening 710*f* and the second opening 710*e* are formed to face each other. The valve body 710*a* can assume two shut-off positions to shut off the upstream portion 710*b* between the upstream side and the downstream side thereof. In the first shut-off position showing in FIG. 13, the upstream side of the upstream portion 710*b* and the first opening 710*e* are communicated and the downstream side of the upstream portion 710*b* and the second opening 710*f* are communicated. Besides, in the second shut-off position showing in FIG. 15, the upstream side of the upstream portion 710*b* and the second opening 710*f* are communicated and the downstream side of the upstream portion 710*b* and the first opening 710*e* are communicated.

In the central portion 710*d*, a catalytic unit 730 is arranged. Besides, the particulate filter 700 having the elliptic sectional shape as same as mentioned above with the outer case 700*a* thereof is arranged to penetrate the downstream portion 710*d*.

According to such a construction, as shown by arrows in FIGS. 13 and 14, when the valve body 710*a* assumes the first shut-off position, the exhaust gas flows from the upstream side of the upstream portion 710*b* to the space between the center pipe member 710 and the cover member 720 via the first opening 710*e*, and after passing through the particulate filter 700, it flows to the upstream portion 710*b* via the second opening 710*f*. Thereafter, the exhaust gas passes through the catalytic unit 730 arranged in the central portion 710*c* and flows in the downstream portion 710*d* around the outer case 700*a* of the particulate filter 700 to the downstream exhaust pipe 740.

On the other hand, as shown by arrows in FIG. 15, when the valve body 710*a* assumes the second shut-off position, the exhaust gas flows from the upstream side of the upstream portion 710*b* to the space between the center pipe member 710 and the cover member 720 via the second opening 710*f*, and after passing through the particulate filter 700 in the reverse direction, it flows to the. upstream portion 710*b* via the first opening 710*e*. Thereafter, the exhaust gas passes through the catalytic unit 730 arranged in the central portion 710*c* and flows in the downstream portion 710*d* around the outer case 700*a* of the particulate filter 700 to the downstream exhaust pipe 740.

Besides, as shown in FIG. 16, the valve body 710*a* can assume the release position between the first shut-off position and the second shut-off position. In the release position, the upstream portion 710*b* of the center pipe member 710 is opened and thus, as shown by arrows in FIG. 16, the exhaust gas does not flow in the space between the cover member 720 and the center pipe member 710, i.e., does not pass through the particulate filter 700, and flows directly in the catalytic unit 730 in the central portion 710*c*.

According to such a construction, the upstream portion 710*b* corresponds to the changeover portion of the device shown in FIGS. 2 and 3 and thus when the valve body 710*a* is changed over from one of the first shut-off position and the second shut-off position to the other, the exhaust gas upstream portion and the exhaust gas downstream portion of the particulate filter 700 can be reversed. Further, when the valve body 710*a* is in the release position, the exhaust gas can bypass the particulate filter 700. Besides, when the valve body 710*a* is pivoted slightly from the release position to the second shut-off position side, only a slight amount of exhaust gas can flow in the particulate filter 700.

Also in the present device for purifying the exhaust gas, the particulate filter 700 carries active-oxygen releasing agent as same as mentioned above. The fuel supply unit 75 as same as mentioned above is arranged in the vicinity of the second opening 710*f* of the cover member 720 corresponding to the second connecting portion of the device shown in FIGS. 2 and 3. In the present device, when the valve body 710*a*, the fuel supply unit 75, the exhaust choke valve 76, and the like are controlled as same as mentioned above, the same effects can be obtained.

Furthermore, in the present device, the exhaust gas always passes through the catalytic unit 730 after bypassing the particulate filter 700 or after passing through the particulate filter 700 in any direction. If the catalytic unit 730 carries an oxidation catalyst, a reduction material such as HC, CO, or the like in the exhaust gas passing therethrough can be purified. In particular, even if a part of the fuel supplied from the fuel supply unit 75 merely passes through the particulate filter, this fuel can be favorably purified. Besides, the purification of reduction materials in the catalytic unit 730 corresponds to the burning of reduction materials and thus its burning heat heats the exhaust gas passing through the catalytic unit 730. Therefore, the exhaust gas of a relative high temperature passes around the particulate filter 700 as shown in FIG. 14 and thus the particulate filter 700 is heated to increase an amount of particulates that can be oxidized and removed from the particulate filter.

Ceria can be carried on the particulate filter as another active-oxygen releasing agent, in addition to the active-oxygen releasing agent that can cause the sulfur poisoning. The ceria absorbs oxygen when the oxygen concentration is high ($Ce_2O_3 \rightarrow 2CeO_2$) and releases active-oxygen when the oxygen concentration decreases ($2CeO_2 \rightarrow Ce_2O_3$). Therefore, in order to oxidize and remove the particulates, the air-fuel ratio of the exhaust gas must be made rich at regular intervals or at irregular intervals. Instead of the ceria, iron Fe or tin Sn can be used.

Figure 17:
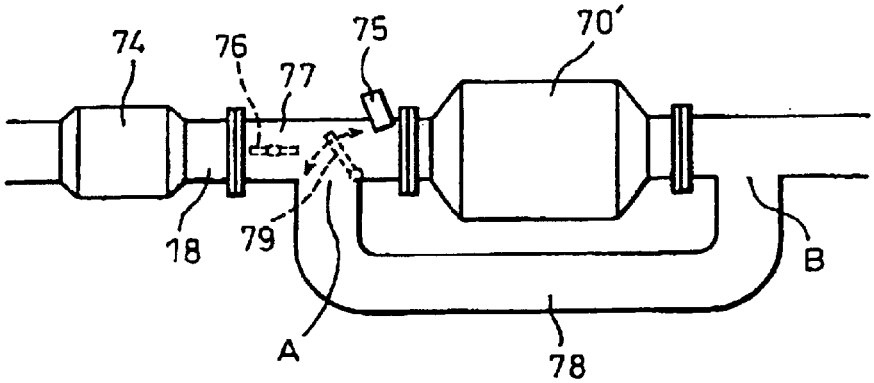
FIG. 17 is a plan view showing another device for purifying the exhaust gas.

FIG. 17 is a plan view showing a further device for purifying the exhaust gas. In the present device, reversing means for reversing the exhaust gas upstream side and the exhaust gas downstream side of the particulate filter 70' is not provided. A bypass passage 78 that bypasses the particulate filter 70' is connected to the exhaust passage 77, in which the particulate filter 70' is arranged, via the exhaust gas branch portion (A) and the exhaust gas join portion (B). The particulate filter 70' has the same construction as the particulate filter 70 shown in FIG. 6, except for the circular sectional shape. In the present device, the $SO_x$ trap unit 74 as same as mentioned above is arranged upstream of the particulate filter 70', the exhaust choke valve 76 as same as mentioned above is arranged between the $SO_x$ trap unit 75 and the exhaust gas branch portion (A) of the bypass passage 78, the fuel supply unit 75 as same as mentioned above is arranged downstream of the exhaust gas branch portion (A) in the exhaust passage 77 to supply fuel to the particulate filter 70'.

A valve body 79 is arranged in the exhaust gas branch portion (A) of the bypass passage 77. Usually, the valve body 79 is made a first position to shut off the bypass passage 78 and thus the exhaust gas passes through the particulate filter 70'. On the other hand, when $SO_x$ is released from the $SO_x$ trap unit 74 or the like, the valve body 79 is made a second position to shut off the exhaust passage 77 and thus the exhaust gas passes through the bypass passage 78. The valve body 79 can be pivoted slightly from the second position to the first position side, and thus the exhaust gas mainly bypasses the particulate filter 70' and only a part of the exhaust gas passes through the particulate filter 70'.

Also, in the present device, the exhaust choke valve 76 and the valve body 79 are close each other and, thus, in the case where they are actuated by the negative pressure actuators, the common negative pressure tank can be used. Besides, when the valve body 79, the fuel supply unit 75, the exhaust choke valve 76, and the like are controlled as same as mentioned above, the same effects can be obtained.

The diesel engine in the above embodiments can change between the low temperature combustion and the normal combustion. However, this does not limit the present invention. Of course, the present invention also can be applied to a diesel engine carrying out only the normal combustion or a gasoline engine emitting particulates and $NO_x$.

Although the invention has been described with reference to specific embodiments thereof, it should be apparent that numerous modifications can be made thereto, by those skilled in the art, without departing from the basic concept and scope of the invention.

What is claimed is:

1. A device for purifying the exhaust gas of an internal combustion engine, comprising:

a particulate filter carrying an active-oxygen releasing agent that can cause the sulfur poisoning;

a $SO_x$ trap unit arranged upstream of said particulate filter;

a bypass means for making the exhaust gas mainly bypass said particulate filter when $SO_x$ is released from said $SO_x$ trap unit, an exhaust choke valve for exhaust brake is arranged between said $SO_x$ trap unit and an exhaust gas branch portion of said bypass means; and a fuel supply unit arranged downstream of the $SO_x$ trap unit and the exhaust gas branch portion, and in the portion of the exhaust passage in which said particulate filter is arranged.

2. A device according to claim 1, wherein the volume of said $SO_x$ trap unit is smaller than that of said particulate filter.

3. A device according to claim 1, wherein the exhaust gas bypassing said particulate filter by said bypass means passes around an outer case of said particulate filter.

4. A device according to claim 3, wherein said exhaust gas bypassing said particulate filter passes through a catalytic unit before passing around the outer case of said particulate filter.

5. A device according to claim 4, wherein said catalytic unit carries an oxidation catalyst.

6. A device according to claim 1, wherein when $SO_x$ is released from said $SO_x$ trap unit, said exhaust choke valve is operated to a valve shut-off side to decrease an amount of exhaust gas passing through said $SO_x$ trap unit.

7. A device according to claim 6, wherein $SO_x$ is released from said $SO_x$ trap unit in engine decelerations.

8. A device according to claim 6, wherein said active-oxygen releasing agent holds $NO_x$ to combine the $NO_x$ with oxygen when excessive oxygen is present in the surrounding and releases to decompose the combined $NO_x$ and oxygen into $NO_x$ and active-oxygen when the oxygen concentration in the surrounding drops.

9. A device according to claim 8, wherein when $SO_x$ is released from said $SO_x$ trap unit, fuel is supplied from the fuel supply unit to the portion of the exhaust passage, in which said particulate filter is arranged, to decrease the oxygen concentration in said particulate filter, thereby $NO_x$ is released from said particulate filter.

10. A device according to claim 9, wherein said bypass means for making the exhaust gas bypass said particulate filter makes the exhaust gas, except a slight amount of exhaust gas, bypass the particulate filter when $SO_x$ is released from said $SO_x$ trap unit.

* * * * *